US005509787A

United States Patent [19]

Valdes

[11] Patent Number: 5,509,787

[45] Date of Patent: Apr. 23, 1996

[54] HYDRAULIC ACTUATOR FOR PRESSURE SWITCH OF FLUIDIC SYSTEM

[76] Inventor: Osvaldo J. Valdes, Las Lavandulas, 10, 168 Las Condes, Santiago, Chile

[21] Appl. No.: 319,512

[22] Filed: Oct. 7, 1994

[51] Int. Cl.[6] ..... F04B 49/00

[52] U.S. Cl. ..... 417/38; 417/43; 200/81.9 R; 137/219

[58] Field of Search ..... 417/38, 43; 200/81.9 R, 200/82 R; 137/219, 540; 60/431

[56] References Cited

U.S. PATENT DOCUMENTS

| | | | |
|---|---|---|---|
| 3,560,706 | 2/1971 | Fonseca | 200/81.9 R |
| 3,739,810 | 6/1973 | Horan, Jr. . | |
| 3,782,858 | 1/1974 | Deters | 417/38 |
| 3,871,792 | 3/1975 | Gritz . | |
| 3,876,336 | 4/1975 | Nash . | |
| 4,124,332 | 11/1978 | Nishijyo . | |
| 4,281,968 | 8/1981 | Akers . | |
| 4,329,120 | 5/1982 | Walters | 417/38 |
| 5,099,544 | 3/1992 | Yamamoto | 200/81.9 R |
| 5,190,443 | 3/1993 | Valdes . | |
| 5,197,859 | 3/1993 | Siff . | |

FOREIGN PATENT DOCUMENTS

| | | | |
|---|---|---|---|
| 217334 | 10/1986 | United Kingdom | 200/81.9 R |
| 2198883 | 6/1988 | United Kingdom | 200/81.9 R |

*Primary Examiner*—Richard A. Bertsch
*Assistant Examiner*—Xuan M. Thai
*Attorney, Agent, or Firm*—Choate, Hall & Stewart

[57] ABSTRACT

An hydraulic actuator of a constant pressure fluidic supply system is disclosed in which a movable shuttle disposed within a generally cylindrical housing forms therewith a plurality of piston and cylinder assemblies. Displacement of the shuttle within the housing is governed substantially by opposing hydrodynamic and hydrostatic forces balanced so as to selectively isolate a pump control pressure switch from system pressure during periods of moderate to high consumption demand and provide communication therewith during periods of low to zero consumption demand. An hydropneumatic tank or a conventional diaphragm tank may be used in combination with the actuator to provide fluidic capacitance to the system. Additional system valving and pressure regulation may be incorporated as desired.

17 Claims, 4 Drawing Sheets

HYDRAULIC ACTUATOR FOR PRESSURE SWITCH OF FLUIDIC SYSTEM

TECHNICAL FIELD

The present invention relates generally to automatic control of a fluidic pump in a pressurized fluidic pumping system and more specifically to an hydraulic actuator useful for isolating a pressure switch from system pressure during periods of pump flow greater than a predetermined volumetric flow rate.

BACKGROUND INFORMATION

Fluidic pumping systems such as those presently widely utilized in domestic water supply applications often employ a pressure switch which turns an electrically driven pump on when the system pressure falls below a predetermined cut-in pressure and turns the pump off when the system pressure rises above a predetermined cut-out pressure. Such systems often incorporate a conventional diaphragm tank which includes both pressurized air and system fluid separated by a flexible bladder or other element. Diaphragm tanks are desirable from an operational standpoint as they may reduce cycling of the pump by providing a limited amount of fluidic capacitance in the supply system. Systems of this type, however, may be characterized by supply pressure which varies, depending both on the amount of fluid in the tank as well as the operational state of the pump. Supply pressure variability is generally undesirable from the standpoint of a user. Such systems are also relatively expensive to procure initially as well as maintain due to the initial cost and limited life of both the diaphragm tank and pump motor. Additionally, the tank displaces a relatively large volume thereby requiring accommodation of the apparatus in a zone of sufficient size which might otherwise be utilized for more advantageous purposes.

A recent substantial improvement in fluidic pumping systems useful in applications of the aforementioned type is disclosed in U.S. Pat. No. 5,190,443 entitled Hydropneumatic Constant Pressure Device, granted to Valdes on Mar. 2, 1993, the disclosure of which is herein incorporated by reference. Briefly, the improved system disclosed therein includes a motor driven pump controlled by a pressure switch mounted to an hydraulic actuator port which is selectively isolated from internal system pressure during periods of consumption demand above a predetermined flow rate. Firstly, by operating the pump continuously during periods of demand, the system advantageously supplies a substantially constant pressure output. Further, depending on the particular application, pump motor cycling may be reduced significantly and the concomitant reduction in motor life associated therewith avoided. Additionally, the system obviates the cost and space claim associated with large, short-lived diaphragm tanks, system capacitance being provided by a small hydropneumatic arrangement as disclosed therein.

SUMMARY OF THE INVENTION

A less complex, inexpensive, improved hydraulic actuator having a selectively isolatable pressure switch port useful for controlling a fluidic pump in a pressurized supply system to deliver fluid at substantially constant pressure is comprised of a generally cylindrical housing having disposed therein a movable shuttle. The housing and shuttle combine to form three collinear piston and cylinder assemblies which cooperate, as a result of opposing hydrodynamic and hydrostatic forces, to isolate the pressure switch port during periods of fluidic flow through the actuator housing above a predetermined threshold volumetric flow rate. Such periods may correspond, for example, to moderate to high consumption. During these periods, the pump is activated and remains on, supplying fluidic flow to a consumption demand at substantially constant pressure. At flow rates at or below the threshold value, for example, corresponding to zero or low consumption demand, the shuttle is displaced in the housing permitting communication of system pressure, already above cut-out pressure, to the pressure switch port which deactivates the pump.

Depending on the particular application, the actuator may be advantageously used with a fluidic pump and pressure switch in combination with a variety of components, including small hydropneumatic tanks or more conventional diaphragm tanks with or without additional valving. Conventional pressure regulation apparatus may also be employed to limit pressurization of a diaphragm tank or supply system piping if desired.

BRIEF DESCRIPTION OF DRAWINGS

The novel features believed characteristic of the invention are set forth and differentiated in the appended claims. The invention in accordance with preferred and exemplary embodiments, together with further advantages thereof, is more particularly described in the following detailed description taken in conjunction with the accompanying drawings in which:

MODE(S) FOR CARRYING OUT THE INVENTION

Figure 1:
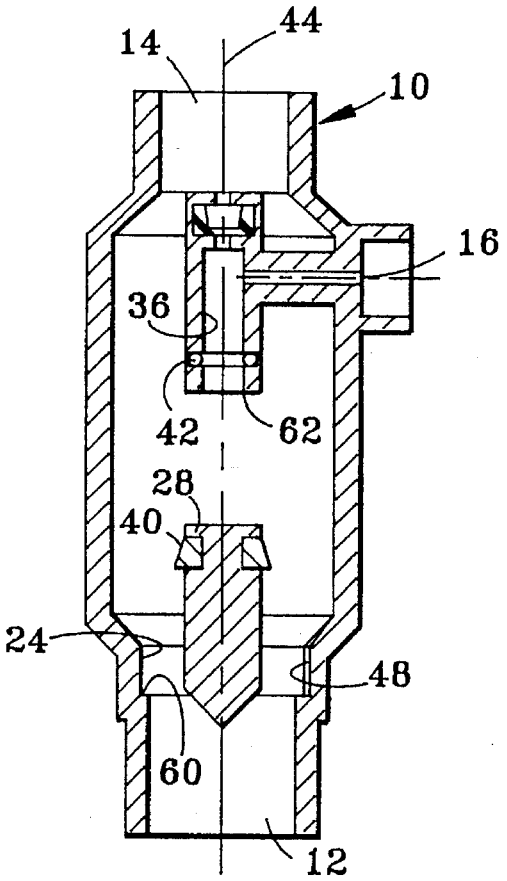
FIG. 1 is a schematic, sectional view of an hydraulic actuator housing in accordance with a preferred embodiment of the present invention.

Shown in FIG. 1 is a schematic, sectional view of an hydraulic actuator housing 10 in accordance with a preferred embodiment of the present invention. Housing 10 is generally cylindrical and includes an inlet 12, at least one outlet 14 and a system pressure port 16 suitably configured to receive a pressure switch flange or otherwise provide a pressure tight fitting for connection with a pressure switch. The inlet 12 may be conventionally connected to an outlet of a fluidic pump, for example by a threaded connection, and the outlet 14 similarly connected to piping conveying pressurized fluid to a consumption device such as a faucet (not shown).

Figure 2:
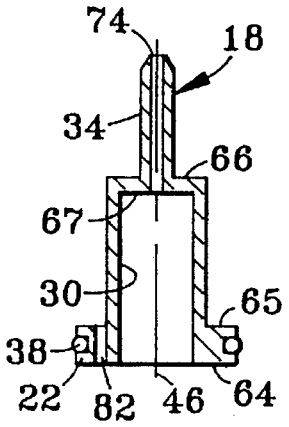
FIG. 2 is a schematic, sectional view of an hydraulic actuator shuttle in accordance with a preferred embodiment of the present invention.

FIG. 2 depicts a schematic, sectional view of an hydraulic actuator shuttle 18 which is sized and configured to be received in close fitting relation within the housing 10. The cylindrical shuttle 18 cooperates with housing 10, constituting therewith a plurality of collinear piston and cylinder assemblies, namely sensor assembly 20, tractor assembly 26 and blocker assembly 32, as depicted in an assembled actuator 50 shown in FIG. 3B.

Referring back to FIGS. 1 and 2, the sensor assembly 20 includes sensor piston 22 of shuttle 18, sensor cylinder 24 of housing 10 and sensor seal 38; the tractor assembly 26 includes tractor piston 28 of housing 10, tractor cylinder 30 of shuttle 18 and tractor seal 40; and the blocker assembly 32 includes blocker piston 34 of shuttle 18, blocker cylinder 36 of housing 10 and blocker seal 42. The sensor cylinder 24 also includes an optional longitudinal bypass channel 48, the purpose of which is discussed in detail below. With the exception of the bypass channel 48, the sensor, tractor and blocker assemblies 20, 26, 32 are substantially symmetrical about respective longitudinal axes 44, 46 of housing 10 and shuttle 18. The axes 44, 46 are substantially collinear and coincident in the assembled state. In the exemplary embodiment depicted, sensor seal 38 is an O-ring retained by the sensor piston 22, tractor seal 40 is a V-seal retained by the tractor piston 28, and blocker seal 42 is an O-ring retained by the blocker cylinder 36; however, other types of seals and retention schemes may be substituted therefore and are considered within the scope of this invention.

In the assembled state, the shuttle 18 is substantially free to move longitudinally in the housing 10 within a predetermined range, subject primarily to opposing hydrodynamic and hydrostatic forces, as well as seal drag, as will be discussed in greater detail below. The range of motion of shuttle 18 is established by annular seat 60 of sensor cylinder 24 and annular end face 62 of blocker cylinder 36, which respectively abut portions of annular flow face 64 and annular pressure face 66 of shuttle 18 at shuttle travel limits.

Figure 3A:
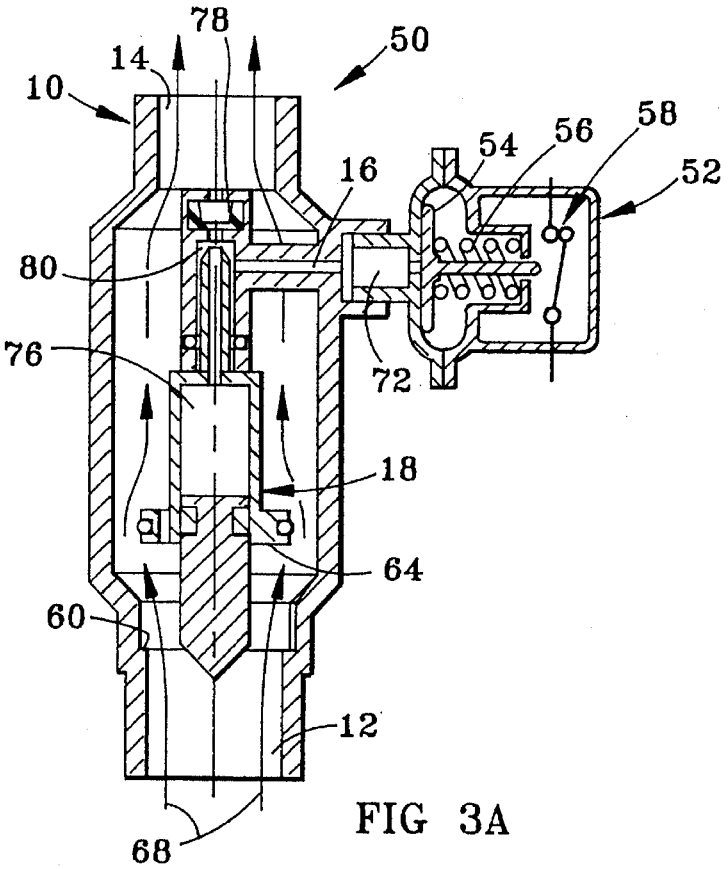
FIG. 3A is a schematic, sectional view of an assembled hydraulic actuator apparatus in a first operational state.
Figure 3B:
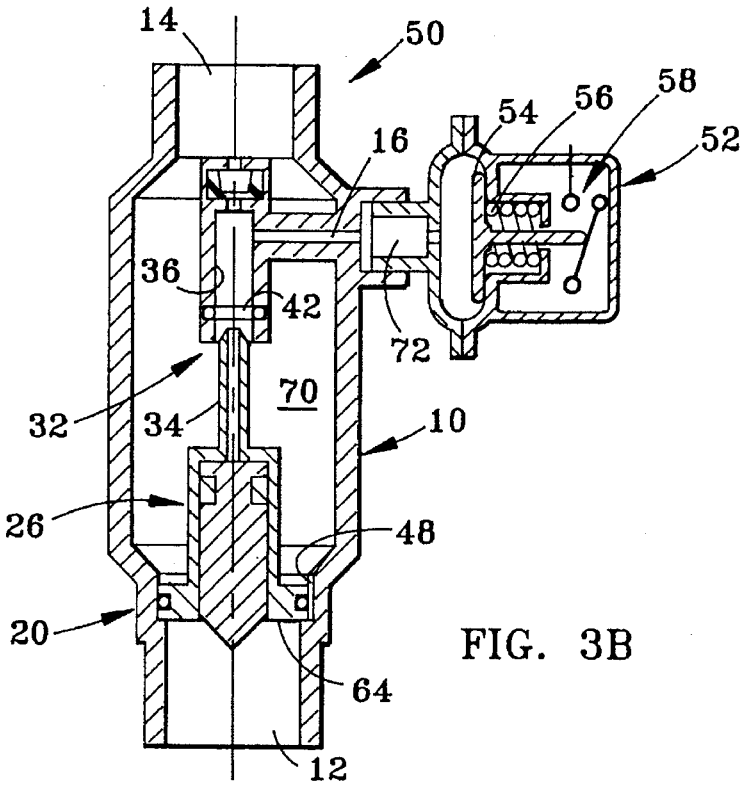
FIG. 3B is a schematic, sectional view of an assembled hydraulic actuator apparatus in another operational state.

FIGS. 3A and 3B schematically depict an hydraulic actuator assembly 50 in two different operational states, in combination with a pressure switch 52 for controlling a pump. FIG. 3A depicts a high flow state in which the shuttle 18 is displaced in a downstream direction in the housing 10, as shown in the figure, due to the net hydrodynamic force acting thereon by fluidic flow, shown generally at 68, entering housing 10 at inlet 12 and exiting at outlet 14. Any fluid in tractor assembly volume 76 is below system pressure in this state and urges upstream displacement of the shuttle 18 as discussed in further detail below. FIG. 3B depicts a zero or low flow state below a predetermined volumetric flow rate, in which the shuttle 18 is fully displaced in an upstream direction in the housing, as shown in the figure, due to the net hydrostatic force acting thereon by pressurized fluid in the housing 10, shown generally at 70.

Pressure switch 52 is conventional in nature, depicted here as being of the normally-closed electrical contact variety. Switch 52 includes a plunger 54 biased by compression spring 56 so that electrical contacts 58 are closed when the pressure of pressure port 16 sensed in pressure switch cavity 72 is less than a predetermined cut-out pressure. Closed contacts 58 may be used to complete an electrical circuit energizing an electric motor connected to a fluidic pump (not shown) providing pressurized fluid to inlet 12.

The operation of the actuator 50 in a typical consumption cycle may be described beginning with the configuration of FIG. 3B, a pressurized fluidic system having a system pressure, $P_s$, with no consumption and hence zero flow through the housing 10. System pressure is uniform throughout the housing 10, including at inlet 12, the bypass channel 48 ensuring normalization of system pressure across the sensor assembly 20. The shuttle 18 is therefore exposed to uniform pressure loading along all external, exposed surfaces including flow face 64 and pressure face 66. Shuttle 18 is advantageously configured such that surface area exposed to the pressurized fluid 70 at system pressure results in a net upstream longitudinal force, as depicted in the figure, which acts to seat the sensor piston 22 against seat 60, substantially blocking the inlet 12 to flow. In other words, the total area of radial surfaces of shuttle 18 exposed to system pressure from above, that is annular pressure face 66 and annulus 65, is greater than the total area of radial surfaces of shuttle 18 exposed to system pressure from below, namely annular flow face 64, as shown in FIG. 2. Differential surface area 67 is subject to a lower pressure than system pressure, this lower pressure being reduced further as tractor assembly volume 76 increases during downstream displacement of the shuttle 18. As pressure in volume 76 decreases, so too does pressure in pressure switch cavity 72, being in flow communication therewith by way of a blocker piston vent 74, preventing cut-out actuation of the pressure switch 52 during shuttle displacement. The net hydrostatic force acting on the shuttle 18 in the upstream direction may be conventionally determined as being approximated by the product of differential area 67 and the differential pressure acting thereon.

In this operational state with the shuttle 18 reaching full upstream travel, system pressure is being communicated to the pressure switch 52. The blocker piston 34 is displaced in the blocker cylinder 36 a sufficient distance to permit system pressure normalization across the blocker seal 42 and resultant communication of system pressure to pressure switch cavity 72 via pressure port 16. Plunger 54 is displaced against the spring 56 due to the net force acting thereon by the system pressure. The electrical contacts 58 are open; therefore, the electrically driven pump is idle.

Upon initiation of consumption, occasioned for example by the opening of a faucet or other device in flow communication with the outlet 14, pressure throughout the fluidic system, including throughout the actuator 50, falls. As the pressure at port 16 and pressure switch cavity 72 falls below a predetermined cut-out pressure, the plunger 54 is displaced outwardly or to the left, as shown in the figure, due to the bias of the spring 56 and the electrical contacts 58 are closed energizing an electrically driven pump. Pressurized fluidic output flow 68 from the pump encounters an actuator inlet 12 substantially blocked by movable flow face 64 of sensor piston 22 and fixed tractor piston 28. The hydrodynamic force of the fluidic flow 68, being sufficient to overcome any remaining net hydrostatic force on the shuttle 18, acts to displace the shuttle 18 from seat 60 in a downstream direction as depicted in FIG. 3A. As the shuttle 18 is displaced, the blocker piston 34 enters the blocker cylinder 36. Blocker piston 34, blocker cylinder 36 and blocker seal 42 cooperate to isolate pressure port 16 and volume 76 from rising system pressure as long as the shuttle 18 is so displaced. As a result, contacts 58 in pressure switch 52 remain closed and the pump runs continuously, thereby providing a substantially constant pressure supply for consumption, as long as consumption remains at a sufficiently high level that the net hydrodynamic force acting on shuttle 18 is greater than the net hydrostatic force acting thereon, thereby maintaining displacement of the shuttle 18 in the manner depicted.

As the consumption demand is reduced, for example due to partial closure of a faucet, the volumetric flow rate of the fluidic flow 68 decreases. At some point, the hydrodynamic force of the fluidic flow 68 acting on the shuttle 18 is insufficient to displace the shuttle pressure face 66 against blocker cylinder end face 62 and the shuttle 18 migrates in an upstream direction, downwardly in the figure, until the net hydrodynamic and hydrostatic forces acting thereon are balanced. The lower the rate of fluidic flow 68, the more the shuttle 18 is displaced in an upstream direction as depicted in the figure. Once fluidic flow 68 passing through the housing 10 falls below a predetermined volumetric flow rate, the net hydrostatic force on the shuttle 18 is sufficient to fully displace the shuttle flow face 64 against seat 60. The blocker piston 38, being displaced in the blocker cylinder 36 a sufficient distance to permit system pressure normalization across the blocker seal 42, allows communication of system pressure to pressure switch cavity 72 via pressure port 16. At this stage, system pressure is greater than cut-out pressure and plunger 54 is displaced against the spring 56 due to the net force acting thereon by the system pressure, the electrical contacts 58 are opened and pump operation ceases. The fluidic system remains pressurized and the pump remains idle until consumption is initiated once again, as previously described.

As mentioned previously, beyond being controlled by opposing hydrodynamic and hydrostatic forces, the motion of the shuttle 18 is also subject to seal drag, which is related to friction between the mobile shuttle 18 and the housing 10 caused by compression of seals 38, 40, 42 disposed therebetween. The net hydrostatic force acting on the shuttle 18 in a zero flow condition should be of sufficient magnitude to overcome seal drag so as to reliably abut shuttle flow face 64 against housing seat 60 to prevent continued isolation of the pressure switch port 16 after consumption has terminated resulting in unnecessary operation of the pump. For a given pump having a characteristic pressure profile with a known maximum pressure output, the net hydrostatic force acting on the shuttle 18 at zero flow may be predetermined as desired by selecting the magnitude of the differential area 67 exposed to lower pressure in volume 76. The greater the differential area 67 for a given pressure differential, the greater the closure force will be. Thus, in a typical application for a pump producing a maximum output pressure of fifty pounds per square inch acting on a shuttle 18 with a differential radial surface area 67 of 0.50 square inches, the closure force at zero flow would be up to about twenty-five pounds force in the upstream longitudinal direction. While the closure force should be selected great enough to reliably overcome any seal drag, the closure force should not be so large as to cause excessive pressure loss of fluidic flow 68 passing through the actuator 50.

In order to further ensure reliable operation of the hydraulic actuator assembly 50 in a fluidic pumping system with varying consumption demand, in a preferred embodiment, the tractor assembly 26 may include a vent 74 disposed longitudinally through blocker piston 34 as shown, for example, in FIG. 2. Vent 74 provides for normalization of pressure between the variably sized volume 76 enclosed by tractor assembly 26 and pressure port 16. In this manner, the force required to displace the shuttle 18 is not substantially related to the volume 76 within the tractor assembly nor to that within switch cavity 72. Further, in order to prevent the occurrence of overpressurization of the pressure switch 52 or undesirable resistance to displacement of the shuttle 18 caused by fluid trapped in the tractor or blocker assemblies 26, 32, a relief valve 78 may be provided which communicates the respective volumes 76, 80 enclosed by the tractor and blocker assemblies 26, 32 with system pressure, as shown in FIG. 3A. In the embodiment depicted, the relief valve 78 is a U-cup seal; however, any of a variety of relief valve schemes may be incorporated, including a spring loaded ball valve, for example. Any excess, overpressurized fluid trapped in volumes 76, 80 which might tend to falsely actuate the pressure switch 52 or prevent free motion of the shuttle 18 under the net force associated with hydrostatic and hydrodynamic forces acting thereon is automatically dumped through the valve 78 whereupon the fluid joins the fluidic flow 68 or pressurized fluid 70.

Figure 4:
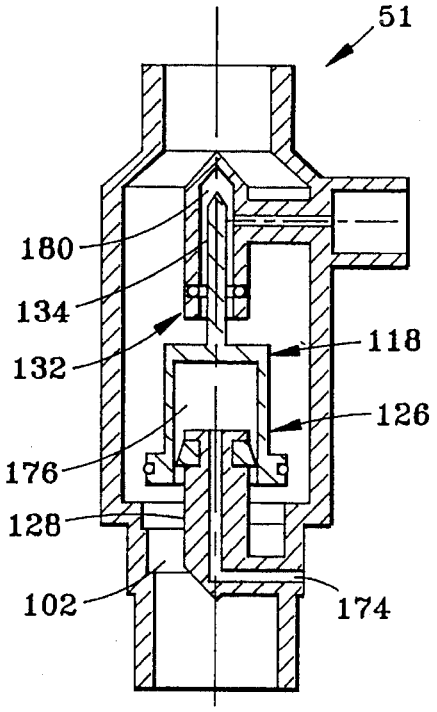
FIG. 4 is a schematic, sectional view of an assembled hydraulic actuator in accordance with an alternate embodiment of the present invention.

In an alternate embodiment hydraulic actuator assembly 51, depicted in FIG. 4, instead of venting volume 176 of tractor assembly 126 to system pressure, vent 174 provides for normalization of internal pressure of tractor assembly 126 with ambient. Vent 174 may be advantageously provided through tractor piston 128 and a radial support 102 thereof. No additional relief valving between blocker assembly 132 and system pressure is required for this configuration, as the fluid displaced from blocker assembly volume 180 due to shuttle movement is of insufficient volume to overpressurize a conventional pressure switch or cause considerable resistance to displacement of the shuttle 118. If desired, however, relief valving to system pressure may be provided in a manner similar to that depicted in FIG. 3A. All other elements and operational characteristics are similar to the preferred embodiment depicted in FIGS. 3A and 3B.

The opposing hydrostatic and hydrodynamic forces acting on the shuttle 18 permit the hydraulic actuator assembly 50 to operate in the advantageous manner described. As may be readily appreciated, much leeway is afforded in the relative sizing of diameters and longitudinal lengths associated with the sensor, tractor and blocker assemblies 20, 26, 32 to achieve a desired operating characteristic; however, some general guidelines are relevant. For example, the diameter of sensor piston 22 is preferably larger than the diameter of tractor piston 28 in sufficient degree to provide proper radial area of flow face 64 upon which hydrodynamic forces primarily act. Pressure loss of the fluidic flow 68 passing through the assembly 50 may also be reduced by using a relatively large sensor piston diameter and small tractor piston diameter to reduce blockage with the shuttle 18 displaced in a downstream direction as shown in FIG. 3A. Additionally, the diameter of tractor piston 28 is preferably larger than that of blocker piston 34 to provide sufficient area of pressure face 66 and differential surface 67 upon which hydrostatic closure forces primarily act. In general, an area ratio of sensor piston diameter to tractor piston diameter of about two to one has been found to facilitate force balance operation in an advantageous manner.

Further, longitudinal lengths of the sensor piston 22 and sensor cylinder 24 are preferably shorter than those of the tractor piston 28 and tractor cylinder 30 to minimize pressure loss of fluidic flow 68 passing thereby. As mentioned above, the length of blocker piston 34 and the placement of blocker seal 42 in the blocker cylinder 36 is predetermined to ensure proper isolation of pressure port 16 from system pressure when the shuttle 18 is displaced in a downstream direction, as shown in FIG. 3A, as well as to ensure proper communication of system pressure to the pressure port 16 when the shuttle 18 is fully displaced in an upstream direction, as shown in FIG. 3B.

Figure 5:
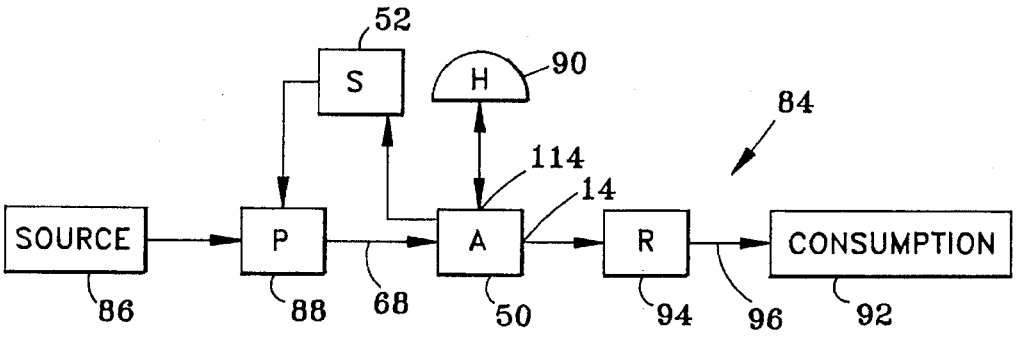
FIG. 5 is a schematic, block diagram of one embodiment of a preferred fluidic pumping system incorporating an hydraulic actuator according to the present invention.

Referring now to FIG. 5, depicted is a schematic, block diagram of one embodiment of a preferred fluidic pumping system 84 incorporating the present invention. An electrically driven pump 88 draws or receives fluid from a source 86, discharging fluidic flow 68 through hydraulic actuator assembly 50 ultimately to consumption 92. Operation of the pump 88 is controlled by pressure switch 52 selectively isolatable from system pressure as discussed hereinabove.

Without more, the system 84 would function as intended; however, additional elements may be provided to enhance the operation of the system or otherwise regulate system output. For example, an hydropneumatic tank 90 may be attached to an outlet 114 either connected to or separate from primary outlet 14 of the actuator 50, to provide fluidic capacitance to the system 84. As described in detail in the aforementioned patent to Valdes which has been incorporated herein by reference, tank 90 includes a pocket of gas, such as air, which is compressed by pressurized fluid 70 from actuator 50. For small amounts of consumption or for minor downstream leakage in the system 84, the tank 90 would supply the necessary volume without the need for frequent cycling of the pump 88. The hydropneumatic tank 90 may also include a self-contained air-injection pumping apparatus for automatically replenishing air within the tank consumed by operation of a fluidic system as disclosed by Valdes.

While system 84, according to the present invention, is applicable to new construction fluidic supply systems, the invention is equally suitable for retrofitting existing systems, for example, of the domestic water supply variety. In general, high, substantially constant pressure output is a desirable supply system characteristic; however, where there exists a concern due to high pressure afforded by system 84, especially on existing piping or consumption devices in poor condition, system pressure may be suitably limited by addition of a pressure regulator 94 of conventional configuration. The regulator 94 may be advantageously located downstream of pump 88, for example downstream of actuator 50, and upstream of any fragile piping 96. Inclusion of regulator 94 will permit operation of the system 84 with a high pressure output pump 88 with supply piping 96 which may be in poor condition or consumption devices otherwise unable to accommodate high system pressure afforded by the system 84.

Figure 6:
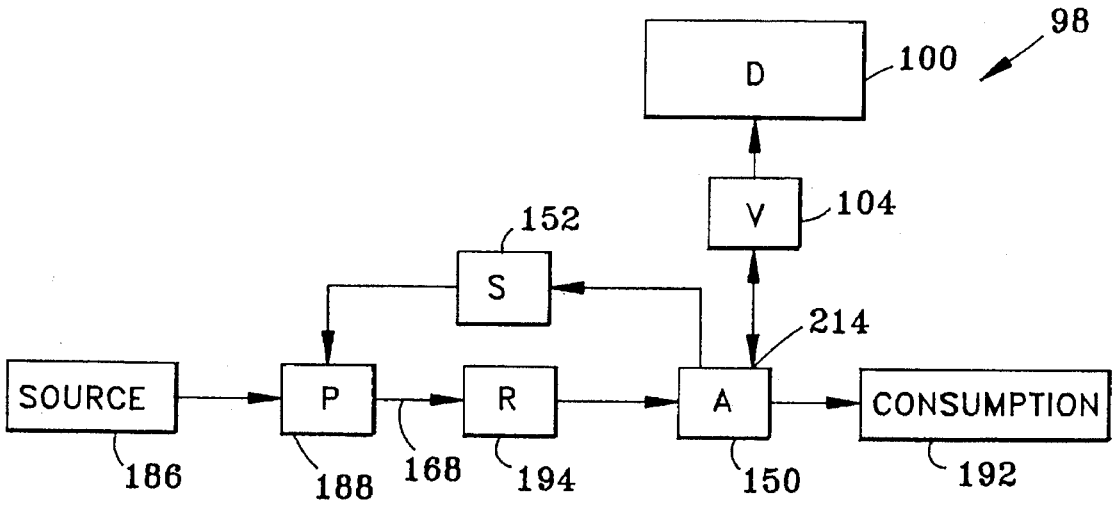
FIG. 6 is a schematic, block diagram of an alternate embodiment of a fluidic pumping system incorporating an hydraulic actuator according to the present invention.

The teachings of this invention are also applicable to fluidic supply systems in which it is deemed desirable to maintain a relatively large fluidic capacitance, greater than that provided by an hydropneumatic tank 90. FIG. 6 depicts a schematic, block diagram of an alternate embodiment of a fluidic pumping system 98 incorporating an hydraulic actuator 150 according to the present invention. An electrically driven pump 188 draws or receives fluid from a source 186, discharging fluidic flow 168 downstream through hydraulic actuator assembly 150 to consumption 192. Operation of the pump 188 is controlled by pressure switch 152 selectively isolatable from system pressure as discussed hereinabove.

A diaphragm tank 100 may be attached to an outlet 214 of the actuator 50, to provide fluidic capacitance to the system 98. As described previously, diaphragm tank 100 includes pressurized air and system fluid separated by a flexible bladder or may comprise another element, such as an expandable, flexible balloon type enclosure. The tank 100 supplies fluid for consumption to the extent of its fluidic capacity without the need for cycling of the pump 188. System 98, configured with a diaphragm tank 100, may also incorporate a conventional pressure regulator 194 to prevent overpressurization of the tank 100 if deemed necessary. The regulator 194 may be disposed between the pump 188 and actuator 150 as shown or alternatively may be disposed between the actuator 150 and the tank 100 to protect the tank 100 from high pressure output of the pump 188.

System 98 may further incorporate a valve 104, disposed between the actuator 150 and the diaphragm tank 100, the purpose of the valve 104 being to terminate fluidic flow to the tank 100 at a predetermined system pressure. Such a valve 104 may be desirable when the actuator 150 is used in combination with a tank 100 having a large fluidic capacitance. Without the valve 104, the system 98 may exhibit an extended recharge cycle, which is related both to tank capacitance and pump flow versus pressure characteristics. Incorporation of valve 104 acts to isolate the tank 100 from the system 98 at a predetermined pressure, to prevent continued operation of the pump 188 at higher pressures where volumetric flow rate is reduced. Shutdown of the pump 188 will occur soon after isolation of the tank 100 occurs due to closure of valve 104. Once valve 104 closes, flow within the system 98 decreases rapidly to below a predetermined threshold volumetric flow rate allowing the pressure switch to be exposed to system pressure due to actuation of the hydraulic actuator 150.

Figure 6A:
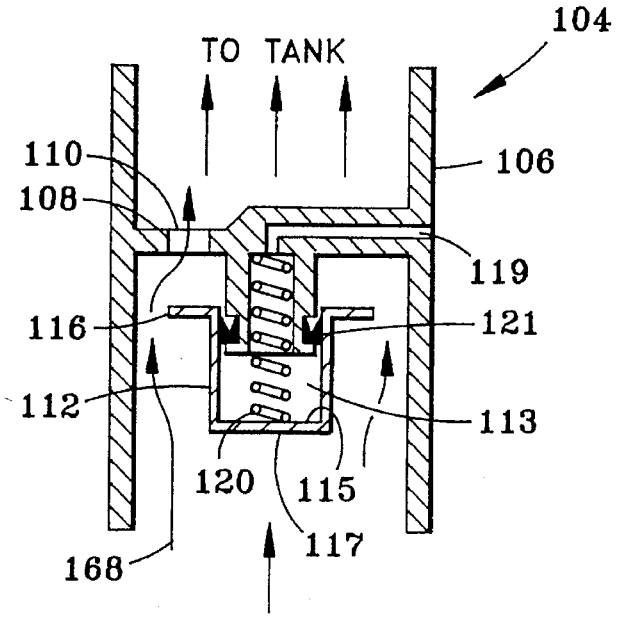
FIG. 6A is a schematic, sectional view of a flow limiting valve utilized in the fluidic pumping system of FIG. 6.

FIG. 6A depicts a typical embodiment of a suitable valve 104 which includes a cylindrical housing 106 with a radial wall 108 having a plurality of apertures 110 disposed therethrough. A generally cylindrical movable element 112 disposed within housing 106 is biased away from wall 108 by an adjustable compression spring 120 disposed therebetween. The spring 120 may be adjusted to modify the compression thereof and resultant spring force at valve closure in a conventional manner, for example, by a threaded fastener (not shown). Volume 113, within the movable element 112, is communicated to ambient through vent 119 passing through wall 108 and isolated from system pressure by seal 121. During the tank recharge cycle, flow 168 passes around the element 112 and through the apertures 110 to fill the tank 100. At a predetermined system pressure, the differential force between system pressure acting on surface area 117 and ambient pressure acting on surface area 115 overcomes the force exerted by spring 120 and the spring 120 is compressed sufficiently, such that movable element annular lip 116 blocks apertures 110 preventing flow therethrough. Flow rate thereafter decreases rapidly in the system to less than a predetermined volumetric flow rate, the shuttle 18 is fully displaced in the upstream direction exposing the pressure switch 152 to system pressure greater than cut-out pressure, and the pressure switch 152 shuts the pump 188 off. The valve 104 remains closed due to the differential pressure thereacross. Whenever system pressure drops below tank pressure, for example when there is a consumption demand or system leakage, the valve 104 opens automatically, permitting fluid stored in the tank 100 to meet the demand within the capacitance limit of the tank 100. When tank capacitance is exhausted, system pressure drops below pump cut-out pressure and the pump 188 is turned on by the pressure switch 152 and the cycle begins anew. Alternatively, the cut-out pressure may correspond to partial discharge of the fluid in the tank 100, in which case the pump 188 is energized sooner.

As stated above, bypass channel 48 in the actuator-sensor assembly 20 serves to normalize the pressure across sensor piston 22 when piston flow face 64 is abutting seat 60 as shown in FIG. 3B. Additionally, the size or cross-sectional area of bypass channel 48 is advantageously configured to permit a predetermined volumetric flow rate of fluid to bypass without displacing the sensor piston 22. This permits recharging or pressurization of a conventional diaphragm tank 100 or an hydropneumatic tank 90 of the type disclosed in the aforementioned patent to Valdes. In these applications, the cut-out pressure of the pressure switch 152, 52 may be set high enough to permit continued operation of the pump 188, 88 after the shuttle 18 is displaced to abut seat 60 to afford pressurization of the system 98, 84 to a desired level. For small hydropneumatic tanks 90, in the range of one to five liters of volume, the bypass channel 48 may be configured as a small, longitudinal groove in the sensor cylinder 24 as depicted. One or more may be provided depending, for example, on the maximum pressure output of the pump 88 and the desired recharge rate of the hydropneumatic tank 90. In a typical embodiment, volumetric flow rate through the bypass channel 48 may be about two liters per minute for a system cut-out pressure of fifty pounds per square inch.

For uses of the hydraulic actuator assembly 150 in combination with conventional diaphragm tanks 100, which typically range in size from about eight liters to over four hundred liters, greater bypass flow area may be desirable than readily afforded by bypass channel 48 to achieve a desirable recharge rate. Instead of or in addition to bypass channel 48, one or more apertures 82 disposed through sensor piston 22 may be provided as depicted in FIG. 2. Inclusion of such apertures 82 understandably reduce the hydrodynamic force acting on the shuttle 18 during periods of fluidic flow while not substantially affecting the net hydrostatic load thereon.

The actuator assembly 50 is advantageously configured to facilitate manufacture by injection molding, without the need for costly post-molding machining steps in the manufacture thereof. All pistons, cylinders, vents and seal grooves may be used in the as-molded condition. In a preferred embodiment, both housing 10 and shuttle 18 are each molded in a unitary manner of commercially available nylon polymer such as Delrin, a registered trademark of Dupont, although any suitable material may be employed. Housing 10 may also include a split-line, mating radial flange (not shown) disposed longitudinally between tractor piston 28 and blocker cylinder 36 to facilitate installation of the shuttle 18 therein.

In addition to comprising relatively few, simple components, since the movement of the shuttle 18 is controlled by opposing hydrostatic and hydrodynamic forces rather than springs or other biasing elements, the performance of the actuator 50 and any pumping system in which the actuator 50 is utilized is not subject to degradation over time, for example, due to relaxation of spring force, or nonlinear spring effects.

While screens, filters or other such elements are routinely employed in pumping applications in which the fluid being pumped is contaminated with particulates such as sand, actuator 50 has demonstrated admirable operation without such elements, although such elements could be added as desired.

The improved actuator 50 and fluidic pumping systems incorporating the improved actuator 50 are advantageously applied to a wide variety of uses. Applications include, but are not limited to, primary pressure applications with subterranean or surface fluidic sources and pressure boost applications with municipal or other pressurized water sources.

While there have been described herein what are considered to be preferred embodiments of the present invention, other modifications of the invention will be apparent to those skilled in the art from the teaching herein. It is therefore desired to be secured in the appended claims all such modifications as fall within the true spirit and scope of the invention. Accordingly, what is desired to be secured by Letters Patent of the United States is the invention as defined and differentiated in the following claims.

I claim:

1. An hydraulic actuator for selectively communicating an internal fluidic pumping system pressure to a pressure port thereof for controlling a fluidic pump, said hydraulic actuator comprising:

a housing having at least one inlet, one outlet and a pressure port; and a mobile shuttle disposed within and cooperating with said housing thereby constituting:

a sensor assembly comprising a mobile sensor piston disposed in close fitting relation along at least a portion of a perimeter thereof with a fixed sensor cylinder;

a tractor assembly comprising a fixed tractor piston disposed in close fitting relation along at least a portion of a perimeter thereof with a mobile tractor cylinder; and a blocker assembly comprising a mobile blocker piston disposed in close fitting relation along at least a portion of a perimeter thereof with a fixed blocker cylinder, wherein:

said shuttle is displaced within said housing by opposing hydrodynamic and hydrostatic forces such that during periods of fluidic flow through said actuator greater than a predetermined volumetric flow rate, said shuttle is displaced such that said blocker piston prevents communication of system pressure with said pressure port; and during periods of fluidic flow through said actuator equal to or less than a predetermined volumetric flow rate, said shuttle is displaced such that said blocker piston permits communication of system pressure with said pressure port.

2. The invention according to claim 1 wherein:

at least one of said sensor assembly, said tractor assembly or said blocker assembly further comprise means for sealing disposed between said respective piston and cylinder.

3. The invention according to claim 1 wherein said actuator further comprises a bypass sized to permit a predetermined volumetric flow rate therethrough without displacement of said shuttle.

4. The invention according to claim 3 wherein said bypass is disposed in said sensor cylinder and comprises at least one bypass channel.

5. The invention according to claim 3 wherein said bypass is disposed in said sensor piston and comprises at least one aperture.

6. The invention according to claim 1 wherein said tractor piston further comprises a vent disposed therethrough for communicating a volume bounded by said tractor assembly with ambient.

7. The invention according to claim 1 wherein said blocker piston further comprises a vent disposed therethrough for communicating a volume bounded by said tractor assembly with a volume bounded by said blocker assembly.

8. The invention according to claim 1 wherein said pressure port is in fluid communication with a volume bounded by said blocker assembly.

9. The invention according to claim 1 wherein said blocker assembly further comprises a check valve oriented to vent higher pressure fluid within a volume bounded by said blocker assembly to lower pressure system fluid.

10. A fluidic pumping system comprising:

a fluidic pump;

an hydraulic actuator for selectively communicating an internal fluidic pumping system pressure to a pressure port thereof for controlling said fluidic pump, said hydraulic actuator comprising:

a housing having at least one inlet in flow communication with an outlet of said fluidic pump, at least one outlet connectable in flow communication with a system consumption, and a pressure port; and a mobile shuttle disposed within and cooperating with said housing thereby constituting:

a sensor assembly comprising a mobile sensor piston disposed in close fitting relation along at least a portion of a perimeter thereof with a fixed sensor cylinder;

a tractor assembly comprising a fixed tractor piston disposed in close fitting relation along at least a portion of a perimeter thereof with a mobile tractor cylinder; and a blocker assembly comprising a mobile blocker piston disposed in close fitting relation along at least a portion of a perimeter thereof with a fixed blocker cylinder; and a pressure switch connected to said pressure port for selectively providing power to said fluidic pump according to at least one predetermined system pressure value sensed at said pressure port, wherein:

said shuttle is displaced within said housing by opposing hydrodynamic and hydrostatic forces such that during periods of fluidic flow through said actuator greater than a predetermined volumetric flow rate, said shuttle is displaced such that said blocker piston prevents communication of system pressure with said pressure port; and during periods of fluidic flow through said actuator equal to or less than a predetermined volumetric flow rate, said shuttle is displaced such that said blocker piston permits communication of system pressure with said pressure port.

11. The invention according to claim 10 further comprising an hydropneumatic tank in flow communication with said fluidic pump outlet for providing fluidic capacitance to said fluidic pumping system.

12. The invention according to claim 11 wherein said hydropneumatic tank further comprises means for injecting air into said tank.

13. The invention according to claim 10 further comprising a pressure regulator in flow communication with said fluidic pump outlet to limit pressure in said fluidic pumping system.

14. The invention according to claim 10 further comprising a diaphragm tank in flow communication with said fluidic pump outlet for providing fluidic capacitance to said fluidic pumping system.

15. The invention according to claim 14 further comprising a pressure regulator disposed between said fluidic pump outlet and said diaphragm tank to limit pressure in said diaphragm tank.

16. The invention according to claim 14 further comprising a valve means disposed between said fluidic pump outlet and said diaphragm tank to terminate fluidic flow into said tank above a predetermined system pressure.

17. The invention according to claim 16 wherein said valve means comprises a biased element valve.

* * * * *

UNITED STATES PATENT AND TRADEMARK OFFICE

CERTIFICATE OF CORRECTION

PATENT NO. : 5,509,787
DATED : April 23, 1996
INVENTOR(S) : Osvaldo J. Valdes

It is certified that error appears in the above-indentified patent and that said Letters Patent is hereby corrected as shown below:

Title page, below "[22] Filed: Oct. 7, 1994", insert the following Foreign Application Priority Data:

item [30] Foreign Application Priority Data

| | |
|---|---|
| January 26, 1994 | Chile 134-94 |
| May 19, 1994 | Chile 721-94 |

Signed and Sealed this

Third Day of June, 1997

*Attest:*

*Attesting Officer*

BRUCE LEHMAN

*Commissioner of Patents and Trademarks*